US007816616B2

(12) United States Patent
Kenny et al.

(10) Patent No.: US 7,816,616 B2
(45) Date of Patent: Oct. 19, 2010

(54) SORTING SYSTEM USING NARROW-BAND ELECTROMAGNETIC RADIATION

(75) Inventors: Garry R. Kenny, West Linn, OR (US); Arthur G. Doak, Nashville, TN (US)

(73) Assignee: MSS, Inc., Nashville, TN (US)

( * ) Notice: Subject to any disclaimer, the term of this patent is extended or adjusted under 35 U.S.C. 154(b) by 888 days.

(21) Appl. No.: 11/615,052

(22) Filed: Dec. 22, 2006

(65) Prior Publication Data

US 2007/0158245 A1 Jul. 12, 2007

Related U.S. Application Data

(63) Continuation-in-part of application No. 10/921,000, filed on Aug. 18, 2004, now Pat. No. 7,326,871.

(51) Int. Cl.
*B07C 5/00* (2006.01)

(52) U.S. Cl. ..... 209/576; 209/577; 209/579; 209/580; 356/237.1; 356/402; 356/429

(58) Field of Classification Search ..... 209/576, 209/577, 579, 581, 582
See application file for complete search history.

(56) References Cited

U.S. PATENT DOCUMENTS

| | | | | |
|---|---|---|---|---|
| 4,131,540 | A | 12/1978 | Husome et al. | 209/582 |
| 4,541,530 | A | 9/1985 | Kenny et al. | 209/571 |
| 4,657,144 | A | 4/1987 | Martin et al. | 209/546 |
| 4,718,558 | A | 1/1988 | Castaneda | 209/546 |
| 4,909,930 | A | 3/1990 | Cole | 209/564 |
| 4,919,534 | A | 4/1990 | Reed | 356/73 |
| 5,085,325 | A | 2/1992 | Jones et al. | 209/580 |
| 5,134,291 | A | 7/1992 | Ruhl, Jr. et al. | 250/341 |
| 5,141,110 | A * | 8/1992 | Trischan et al. | 209/524 |
| 5,220,172 | A | 6/1993 | Berthold et al. | 250/461.1 |
| 5,242,059 | A | 9/1993 | Low et al. | 209/552 |
| 5,260,576 | A | 11/1993 | Sommer, Jr. et al. | 250/359.1 |
| 5,297,667 | A | 3/1994 | Hoffman et al. | 198/493 |
| 5,314,072 | A * | 5/1994 | Frankel et al. | 209/44.1 |
| 5,318,172 | A | 6/1994 | Kenny et al. | 209/524 |

(Continued)

FOREIGN PATENT DOCUMENTS

EP 0484221 A2 5/1992

OTHER PUBLICATIONS

*Admitted Prior Art*: Applicants admit that it is known in the prior art that a laser source having a wavelength encompassing 532 nm can be used to cause red fluorescence which can be detected as an indicator of the presence of lignin.

*Primary Examiner*—Patrick Mackey
*Assistant Examiner*—Terrell H Matthews
(74) *Attorney, Agent, or Firm*—Waddey & Patterson, P.C.; Lucian Wayne Beavers

(57) ABSTRACT

A system for sorting articles includes a detector system having a plurality of narrow bandwidth sources of electromagnetic energy sequentially illuminating articles passing through the detector system, the detector system further including a collector for collecting electromagnetic energy reflected from the articles; a deflector for deflecting selected articles toward an alternative destination; and a control system, operably connected to the collector and the deflector, for actuating the deflector in response to a sensed parameter of the electromagnetic energy collected in the collector.

36 Claims, 10 Drawing Sheets

U.S. PATENT DOCUMENTS

| | | | | |
|---|---|---|---|---|
| 5,318,173 | A | 6/1994 | Datari | 209/580 |
| 5,333,739 | A | 8/1994 | Stelte | 209/582 |
| 5,423,431 | A | 6/1995 | Westin | 209/539 |
| 5,443,164 | A | 8/1995 | Walsh et al. | 209/580 |
| 5,520,290 | A | 5/1996 | Kumar et al. | 209/580 |
| 5,615,778 | A | 4/1997 | Kaiser et al. | 209/578 |
| 5,675,416 | A | 10/1997 | Campbell et al. | 356/367 |
| 5,676,256 | A | 10/1997 | Kumar et al. | 209/580 |
| 5,770,864 | A | 6/1998 | Dlugos | 250/559.2 |
| 5,813,543 | A | 9/1998 | Gesing et al. | 209/653 |
| 5,848,706 | A | 12/1998 | Harris | 209/580 |
| 5,955,741 | A | 9/1999 | Kayani | 250/559.1 |
| 5,966,217 | A | 10/1999 | Roe et al. | 356/402 |
| 6,060,677 | A | 5/2000 | Ulrichsen et al. | 209/577 |
| 6,068,106 | A | 5/2000 | Brizzi et al. | 198/448 |
| 6,080,950 | A * | 6/2000 | Jalink | 209/577 |
| 6,250,472 | B1 | 6/2001 | Grubbs et al. | 209/44.2 |
| 6,335,501 | B1 | 1/2002 | Khalfan | 209/582 |
| 6,353,197 | B1 * | 3/2002 | Ulrichsen et al. | 209/577 |
| 6,369,882 | B1 | 4/2002 | Bruner et al. | 356/73 |
| 6,374,998 | B1 | 4/2002 | Grubbs et al. | 198/836.2 |
| 6,380,503 | B1 | 4/2002 | Mills et al. | 209/586 |
| 6,497,324 | B1 * | 12/2002 | Doak et al. | 209/522 |
| 6,506,991 | B1 | 1/2003 | Eixelberger et al. | 209/581 |
| 6,509,537 | B1 | 1/2003 | Krieg et al. | 209/579 |
| 6,778,276 | B2 | 8/2004 | Bruner et al. | 356/417 |
| 6,832,783 | B2 | 12/2004 | Lawandy | 283/85 |
| 6,914,678 | B1 * | 7/2005 | Ulrichsen et al. | 356/429 |
| 7,019,822 | B1 | 3/2006 | Doak et al. | 356/73 |
| 7,113,272 | B2 | 9/2006 | Bourely et al. | 356/237.1 |
| 7,262,380 | B1 | 8/2007 | Ulrichsen et al. | 209/577 |
| 2003/0132142 | A1 * | 7/2003 | Kumar | 209/579 |
| 2006/0081510 | A1 * | 4/2006 | Kenny et al. | 209/576 |

* cited by examiner

SORTING SYSTEM USING NARROW-BAND ELECTROMAGNETIC RADIATION

This application is a continuation-in-part of our pending U.S. patent application Ser. No. 10/921,000 filed Aug. 18, 2004, entitled "Sorting System Using Narrow-Band Electromagnetic Radiation", the details of which are incorporated herein by reference.

BACKGROUND OF THE INVENTION

1. Field of the Invention

The present invention relates generally to systems for separating selected articles from a stream of articles, and more particularly, but not by way of limitation, to a system particularly suited for sorting recyclable materials such as different types of plastic containers and paper or cardboard products, including carrier board, from each other.

2. Description of the Prior Art

Environmental campaigns and recycling efforts in many areas have generated a substantial supply of recyclable waste paper and like materials. These materials need to be sorted before they can be recycled. For instance, plastic and glass articles need to be sorted from the stream itself and then further by plastic resin type, color, etc. Colored paper stock often needs to be separated from white stock, and cardboard and carrier board needs to be removed from newsprint. In addition, it is sometimes necessary or desirable to separate printed materials from blank materials. Further, separation processes such as screens designed to remove cardboard and plastic and metal containers from paper streams, often miss some of those materials, requiring additional separation steps. Unfortunately, sorting of waste paper and paperboard, etc. is still currently performed almost entirely by manual sorting. Manual sorting of such materials can be time consuming and expensive, which can render the use of recycled paper less economical than virgin paper material. This is even more apparent when so-called carrier board is present in the waste stream. So-called carrier board, commonly understood to be as the paperstock used in, e.g., cereal boxes, soda or beer can carriers, frozen food boxes, etc., must be sorted manually, as there is currently no effective automated method for doing do.

Numerous automated waste separation techniques are known. However, these techniques are generally designed for the recovery of metals, alloys, municipal waste, mixed recyclables and plastics. Paper (or, more generally, sheeted material) sorting presents unique problems that cannot be overcome by most prior art separation techniques. For instance, the relatively lightweight and flexible nature of paper presents unique problems when sorting is attempted. Indeed, these problems make it difficult to supply paper to a sorting sensor, especially not at a desirable feed rate (usually defined in terms of feet per minute (fpm), but sometimes also in terms of pieces or objects per minute (ppm) or tons per hour (tph)). Without higher speeds, automated sorting systems do not achieve efficiencies substantially greater than manual sorting. The problem is exacerbated where the waste stream includes paper and non-paper waste.

A number of different sorting systems have been proposed in the prior art for sorting various articles based upon the color of the articles or the characteristics of the reflected or transmitted electromagnetic radiation to which the article is exposed. Such systems have been utilized for sorting glass, plastic, paper, newsprint, fruit and other edible items, and the like. Similarly, a number of arrangements have been provided for carrying the articles through an inspection zone, and for exposing the articles to electromagnetic radiation and then collecting and analyzing the reflected and/or transmitted radiation.

For example, U.S. Pat. No. 4,131,540 to Husome et al. discloses a color sorting system wherein light is reflected off tomatoes and the reflected light is collected and analyzed as the tomatoes fly through an inspection zone.

U.S. Pat. No. 4,657,144 to Martin et al. discloses a system for removing foreign material from a stream of particulate matter such as tobacco as it cascades through an inspection zone.

U.S. Pat. No. 4,919,534 to Reed, discloses a system for determining the color of glass bottles, wherein the light energy is transmitted through the glass bottles.

U.S. Pat. No. 5,085,325 to Jones et al. discloses a system of a very common type wherein articles are examined as they are supported upon a moving conveyor belt.

U.S. Pat. No. 5,297,667 to Hoffman et al. discloses a system of utilizing two light sources and a camera to analyze articles as they fly through an inspection zone.

U.S. Pat. No. 5,314,072 to Frankel et al. discloses a system which analyzes the transmissive characteristics of articles which are exposed to x-ray fluorescence.

U.S. Pat. No. 5,318,172 to Kenny et al. discloses a system which distinguishes different types of plastic materials based upon their reflected electromagnetic radiation.

U.S. Pat. No. 5,333,739 to Stelte discloses another system which transmits light through articles, namely glass articles, and analyzes the transmitted light to determine color.

U.S. Pat. No. 5,443,164 to Walsh et al. discloses a plastic container sorting system which utilizes both transmitted electromagnetic energy and reflected electromagnetic energy to analyze and identify articles.

U.S. Pat. No. 5,675,416 to Campbell et al. discloses an apparatus which looks at the transmissive properties of articles to separate them based upon the material of the article.

U.S. Pat. No. 5,848,706 to Harris discloses a sorting apparatus which examines optical characteristics of the articles against a viewing background.

U.S. Pat. No. 5,966,217 to Roe et al. discloses a system for analyzing articles wherein reflected radiation is split into a plurality of streams which are then filtered and analyzed.

It has also been suggested to separate carrier board from a newspaper stream via a color-based identification system. However, this approach is not very effective or accurate since color is a secondary feature of these materials, not a fundamental characteristic.

In a relatively recent and unique approach, Doak et al., in U.S. Pat. No. 6,497,324, disclose a sorting system utilizing a multiplexer to allow a single analyzer unit to be used to analyze electromagnetic signals from each of a plurality of collector units. Although effective, the Doak et al. system requires the operation of complex and highly sensitive software and mechanical components, which can be difficult to maintain.

In addition, as noted above, another problem encountered by waste sorting systems is the identification and separation of carrier board and coated or waxed board material commonly used as, e.g., beverage cartons, cigarette cartons, etc. from other paper materials. More particularly, the separation of white or printed paper stock from an article stream can be accomplished by recently developed systems, leaving newsprint and carrier board in the article stream. Further separation to provide only newsprint in the stream, however, has proven problematic.

Thus, it is seen that although there have been many arrangements proposed for the examination of a stream of articles by analysis of reflected and/or transmitted electromagnetic radiation from the articles, there is a continuing need for improved systems, which may simplify the analytical mechanism and permit the identification of materials (such as carrier board) heretofore found difficult to process.

SUMMARY OF THE INVENTION

A system for sorting articles includes a feed conveyor for conveying the articles toward a first destination. A plurality of sources of narrow bandwidth electromagnetic radiation of differing frequencies are provided for shining electromagnetic energy on the articles in seriatim. The sources are preferably arrayed and actuated such that the individual beams of electromagnetic energy from the sources illuminate the same region of the article as it passes through the sensor region. This can be accomplished spatially or through timing, or both. Each of the sources advantageously has a beam spreader associated with it, for spreading the radiation beam across the width of the conveyor (though preferably not along the length of the conveyor, to avoid overlap with adjoining beams). Additionally, the individual sources may be made up of several sources (arranged perpendicular to the flow direction of the articles) with or without beam spreaders such that wide feed streams can be accommodated. A collector is provided for collecting energy reflected from the articles. A deflector is provided for deflecting selected articles toward an alternative destination. A control system is operably connected to the collector and the deflector for actuating the deflector in response to a sensed parameter (such as color) of the energy collected in the collector.

By providing a series of sources of electromagnetic radiation of narrow bandwidth (i.e., a bandwidth range of from about 5 nm to about 250 nm), the identification and separation of several classes of articles can be accomplished. It is well known that the amount of reflected radiation at specific frequencies varies for differing materials. In the visible range this variation determines the color of an object. In the near infrared range (i.e. from about 680 nm to 2000 nm) the amount of reflected radiation is determined by the molecular structure of the material, and therefore its composition.

Conventional separation systems for recyclable materials typically illuminate the articles with a steady state broadband radiation from a light source such as a halogen lamp. The reflected light is then measured at various frequencies utilizing a spectrometer type system (diffraction grating, etc.) or a system of detectors with individual frequency filter sets. This approach is costly due to the number of expensive optical and detector components required. An improved approach utilizing a multiplexer minimizes the number of detectors and filters required but introduces a mechanical system which limits reliability and throughput speed.

The improved system utilizes a series of narrow bandwidth sources which can be switched on and off very rapidly such that the amount of reflected radiation can be measured at a number of specific frequencies without the necessity of a broadband light source or a multiplexer. Further the shape of the narrow bandwidth source can be selected or shaped to optimize the resulting reflection intensity differences between differing materials and therefore the identification accuracy.

For instance, assuming several individual light sources, aligned in the direction of travel of the articles on the conveyor, each actuated sequentially, as an article travels along the conveyor, a pulse of radiation from each of the sources strikes each article sequentially and in substantially the same place. The reflected radiation is collected by multiple collectors. By analyzing the amount of radiation reflected by an article from each differing radiation frequency the article can be identified as for example, polyethylene terephthalate (PET) plastic, newspaper, brown carrier board, white paper, etc.

Referring to FIG. 9, it can be seen that differing materials reflect differing amounts of electromagnetic radiation at different frequencies (PET is illustrated as a dotted line, high density polyethylene (HDPE) is illustrated as a solid line and paper is illustrated as a dashed line). Identification of the differing materials can be made by selecting illuminating frequencies that correspond to a wavelength region with decreases (or "dips" in the spectrum) in the amount of reflected radiation along with illuminating frequencies at an adjacent region. The ratio of the reflected radiation from these two (or three) frequencies will be different than for another material that does not have a decrease in reflection at one of the frequencies.

For example in FIG. 9, taking the ratio of reflected radiation at 1220 nm versus 1300 nm will give approximately equal intensity (a ratio value of about 1) for both frequencies with paper and PET plastic. For HDPE plastic, however, the ratio of the reflected intensity of 1220 nm versus 1300 nm would be on the order of about 2/7 or about 0.29. If in addition one also measured the ratio of the reflected radiation from 1220 nm and 1660 nm, then paper would again be about 1, while PET plastic would be about 5/2 or about 2.5, with HDPE being about 2/6.3 or about 0.32.

Other methods beside ratiometric calculation can also be used to determine the type of material utilizing the amount of radiation reflected at differing frequencies. These methods include the use of neural net engines, spectrum comparison with predetermined spectrum stored in a look-up table, spectrum stored by training the system with feed materials, or other similar methods.

The number of different frequencies required depends upon the number of different type of materials in the feed stream and the accuracy of identification required. In a typical feedstream of recyclable materials, it is likely that employing eight different frequencies would provide acceptable accuracy. More frequencies may be utilized to obtain increased accuracy.

It can be seen in FIG. 9 that the width of the decreased reflection "dips" varies with material and with wavelength. Current available narrow band radiation sources in general fall into two categories, light emitting diodes (LEDs) and laser diodes. The typical bandwidth of LEDs is shown in FIG. 10, and is on the order of 100 nm when measured from the 20% power level. Laser diodes on the other hand have typical bandwidths of less than 5 nm. LEDs are in general less expensive than laser diodes so their use is preferable when possible.

Laser diodes may be required when the reflection "dip" is very narrow, such as the relatively narrow 940 nm dip for HDPE and the 1660 dip for PET plastic. Contrariwise, the LED radiation bandwidth matches very well with the wider reflection dips of HDPE between 1150 nm and 1250 nm and between 1375 nm and 1475. To obtain the greatest difference in the ratios of the reflected radiation intensity at different frequencies it is desirable to "match" the illuminated spectrum with the spectrum of the reflected radiation "dip".

The power level of available LEDs and laser diodes is limited so matching the illuminator spectrum with the reflected radiation spectrum is advantageous to maximize the signal to noise ratio of the sensor system. Further, laser diodes with acceptable power output are available in fewer frequencies than that of LEDs. Therefore, it may be necessary to modify the output spectrum of an LED at a specific frequency. This can be accomplished, for instance, by placing the appropriate filter between the LED source and the feedstream articles. For example, the PET plastic dip at 1660 is more narrow than a typical LED output spectrum, but wider than that of a typical laser diode. Hence, a filter that limits the LED 20% bandwidth to about 1640 nm to 1690 nm, or 50 nm bandwidth, will result in a better spectrum match than either a laser diode or an LED without a filter.

In practice the identification process would include:

1) Sequentially illuminating the same region of the feedstream articles with each of the different frequency sources as the article passes the region of the sensor.

2) Measuring and storing the reflected radiation levels from each of the sources at a number of positions across the width of the feedstream. The articles are measured in at least 5 places across the feedstream, and are measured often enough that for a given feedstream speed (of say 500 to 1,000 feet per minute), the article is measured in at least five places along the length of the article, or at least such that on average each article is measured in at least 20 to 30 places.

3) Taking ratios of, or comparing the spectrum to, the measured reflected radiation levels at the various frequencies to determine the type of material for each measured area of the article.

4) Determining which type of material the article is substantially composed of by examining the measurements for a majority type of material, or type of material in selected regions of the article, or type of material with the highest contiguous counts.

In another embodiment of the invention, the system is capable of detecting the presence of carrier board (which does not contain lignin) in an article stream having newsprint (which contains lignin) and carrier board by determining the presence of lignin in articles in the stream by measuring the fluorescence of the articles when exposed to electromagnetic radiation at a frequency of about 532 nanometers (nm) ("green" light) and measuring the fluorescence at a frequency between about 600 and 700 nm; articles in which lignin is not detected are deflected to thereby separate carrier board from lignin-containing articles.

In another embodiment of the invention the apparatus includes a plurality of narrow bandwidth sources of electromagnetic energy including at least two sources of differing frequencies within the near-infrared range of from about 680 nm wavelength to about 2000 nm wavelength, for illuminating the articles.

In another embodiment of the invention the apparatus includes a plurality of narrow bandwidth sources of electromagnetic energy including red, green and blue narrow bandwidth sources, and at least four sources of differing frequencies within the near-infrared range of from about 680 nm wavelength to about 2000 nm wavelength, for illuminating the articles.

And in another embodiment, the invention includes a conveyor having a width of at least seven feet.

The present invention further includes methods of using the sorting system and its various components.

It is therefore a general object of the present invention to provide improved apparatus and methods for sorting objects by material and/or color, and particularly for sorting lignin-containing articles from those not containing lignin.

Still another object of the present invention is the provision of a system for sorting objects wherein the objects are analyzed as they travel along a conveyor.

Yet another object of the present invention is the provision of a system for detecting multiple classes of articles flowing along a conveyor without the need for a multiplexer or other complex mechanical systems.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
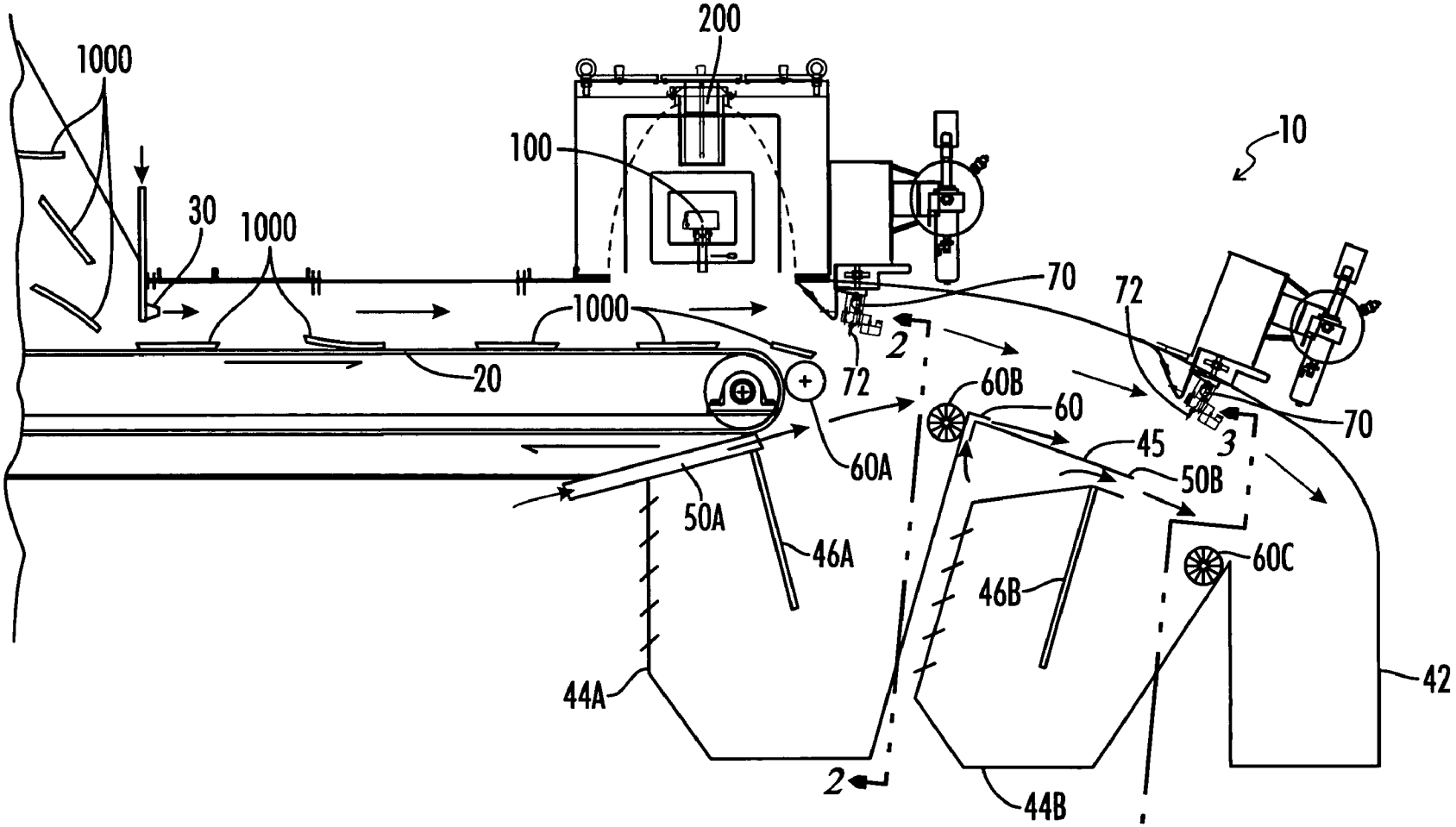
FIG. 1 is a side cross-sectional view of one embodiment of the sorting system of the present invention.

In a preferred embodiment, illustrated in FIG. 1, the present invention relates to a sorting system 10 for sorting material 1000, such as waste paper. Sorting system 10 comprises a path of travel of material 1000, defined by the travel of a conveyor 20. Material 1000 can comprise any waste material for which sorting is desired, such as plastics, glass, etc., but preferably includes paper stock, including newsprint, carrier board and the like. Conveyor 20 can comprise any conveyor used for moving material 1000 or the like, such as a roller or conveyor belt and be formed of fabric, mesh, rubber, etc. as would be familiar to the artisan. Advantageously, conveyor 20 is made of a material which provides sufficient friction to maintain material 1000 traveling the path of travel, to the extent possible. Conveyor 20 is typically driven at the desired rate of travel of material 1000 along the path of travel, as discussed in more detail hereinbelow.

Figure 2:
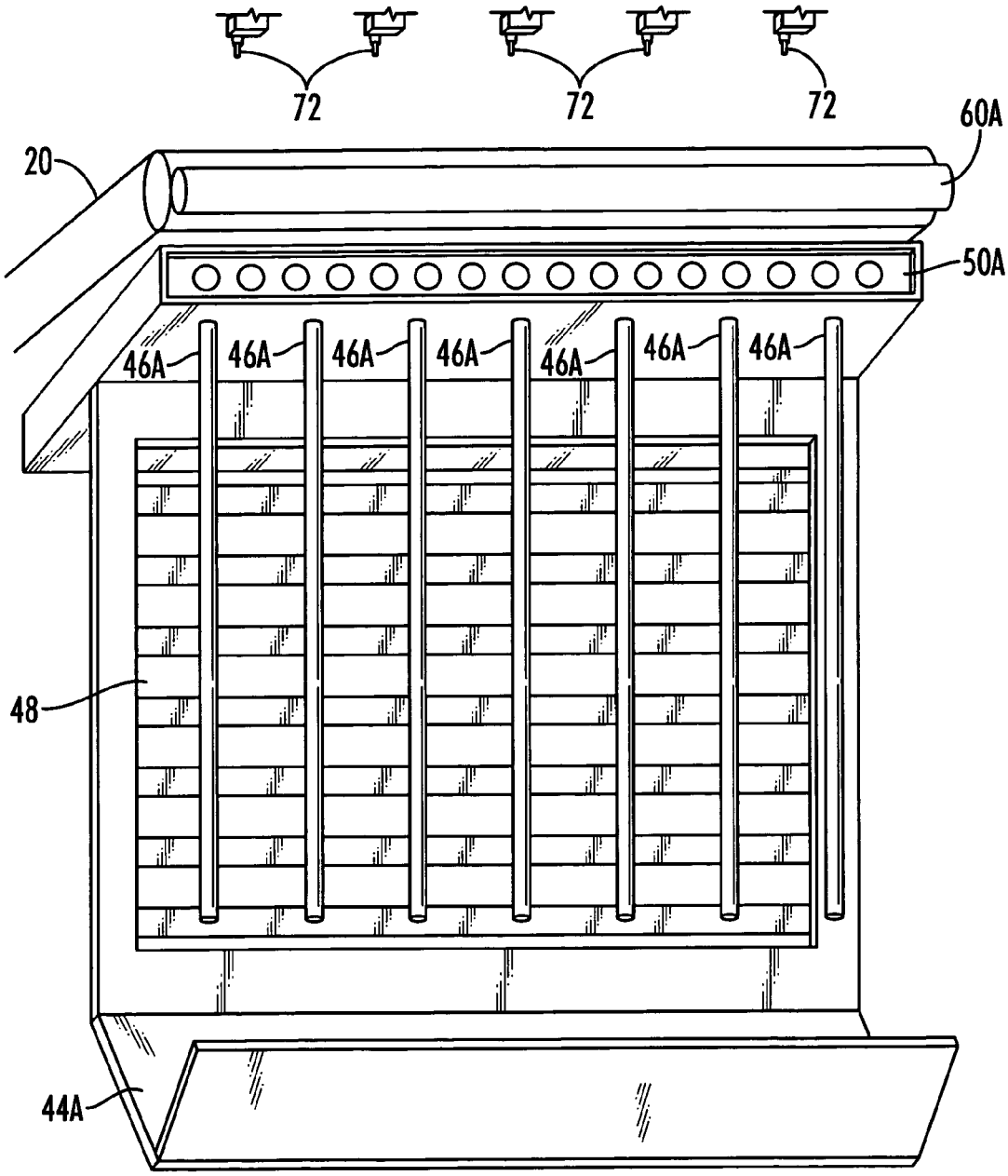
FIG. 2 is a transverse cross-sectional view of the sorting system of FIG. 1, facing against the direction of travel of sheeted material, and taken along lines 2-2.

Still referring to FIG. 2, sorting system 10 can also comprise a source of entrainment gas 30 which produces a flow of gas, especially air, used to entrain material 1000 traveling along conveyor 20, and indicated by arrows. Entrainment air provided by source 30 can maintain material 1000 flowing in the proper path along conveyor 20, even at feed rates as high as 800 fpm, or higher. Indeed, feed rates as high as 1000 fpm and higher can be utilized in sorting system 10 of the present invention.

In addition to the use of entrainment air, it is also contemplated that other systems can be employed to maintain the sheeted material spread consistently on conveyor 20 and flowing in the proper direction. Exemplary of such a system is that disclosed by Grubbs, Kenny and Gaddis in U.S. Pat. No. 6,250,472, the disclosure of which is incorporated herein by reference.

Sorting system 10 can further comprise a plurality of receiving bins 40 into which material 1000 traveling along conveyor 20 can be sorted. Receiving bins 40 comprise a "default" receiving bin 42 into which material 1000 will flow if not directed into any of the preceding receiving bins, as well as at least one "selection" bin 44, and in the embodiment shown in FIG. 1, two selection bins 44A and 44B, into which selected individual ones of material 1000 can be directed, depending on particular characteristics of the selected material 1000.

Selection bins 44A and 44B can also have associated therewith a source of directional gas 50A and 50B. Directional gas sources 50A and 50B comprise conduits for gas (e.g. air) flow in a direction across the top opening of each of selection bins 44A and 44B (and indicated by arrows) to ensure that sheeted material 1000 flowing along with the entrainment gas does not inadvertently enter receiving bins 44A and 44B. In other words, because the openings of receiving bins 40 would ordinarily cause eddying and other current variations of entrainment gas, it is possible that, without the use of directional gas flow, individual ones of material 1000 may enter one of selection bins 44A and 44B when not intended. Directional gas sources 50A and 50B provide a directional gas flow to maintain the flow of material 1000 along the flow of entrainment gas. Typically, directional gas sources 50A and 50B are powered by fans or blowers (not shown).

As illustrated in FIG. 1, directional gas sources 50A and 50B can be arrayed so as to make use of the structures defining the walls of selection bins 44A and 44B. For instance, directional gas source 50A, used for selection bin 44A, can comprise a conduit running between selection bin 44A and conveyor 20. Likewise, directional gas source 50B, used for selection bin 44B, can comprise a conduit extending through the structure forming the wall separating selection bin 44A and selection bin 44B.

Figure 3:
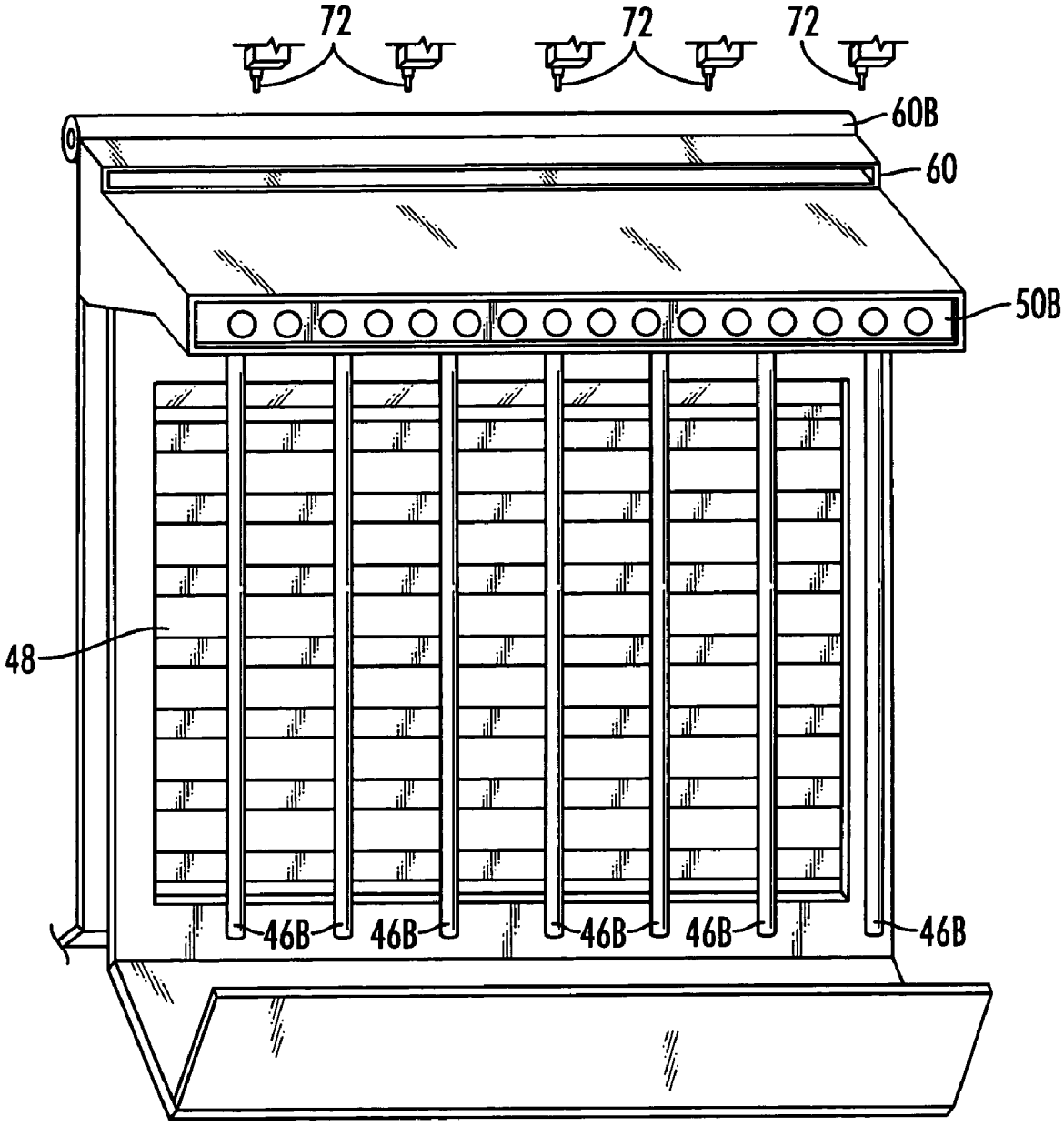
FIG. 3 is a transverse cross-sectional view of the sorting system of FIG. 1, facing against the direction of travel of sheeted material, and taken along lines 3-3.
Figure 4:
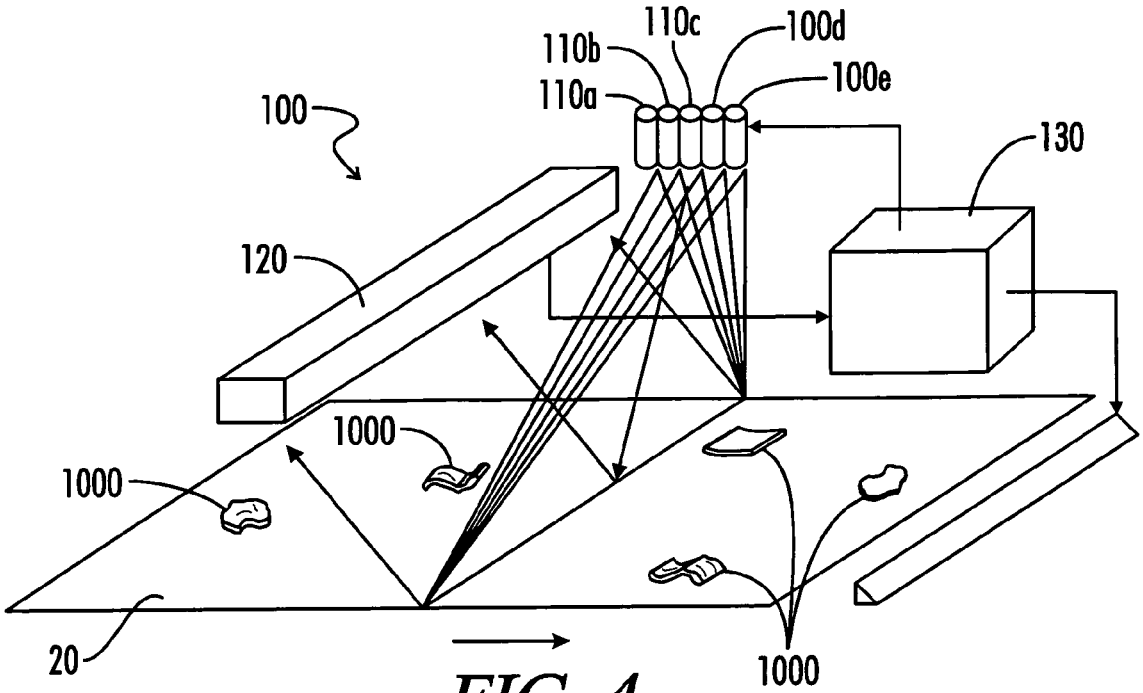
FIG. 4 is a perspective schematic view of the detector system of the present invention.

In addition, the possibility exists on any surface after the termination of conveyor 20 that the flow of material 1000 may be interrupted due to friction. In order to reduce this possibility, in another preferred embodiment, a fluidizing flow of gas can also be created along such surface such as by providing a source of fluidizing gas 60 which creates a fluidizing flow of gas along the surface (indicated by arrows) to keep material 1000 from being hung up. For instance, the gas flow from directional gas source 50B can be partially diverted to be outletted at a proximate end of the surface 45 between the openings of selection bin 44A and 44B, as illustrated in FIGS. 1 and 3. This diverted gas flow forms a fluidizing layer of gas along the surface, thus helping to prevent material 1000 from being caught on surface 45. Moreover, rollers, such as 60A, 60B, and 60C can be positioned to facilitate the flow of material 1000 along the flow path of the entrainment gas, and otherwise to help prevent material 1000 from being caught on corners or other elements of sorting system 10. Rollers 60A, 60B, and 60C can be driven or passive, but are preferably passive rollers.

Each of selection bins 44A and 44B also has a deflector or sorter 70 associated therewith to direct selected individual ones of material 1000 into the respective selection bin 44A or 44B. Sorter 70 preferably comprises an air jet or other like device which, when actuated, will cause the selected material 1000 to pass through any directional gas flow across the opening of the specific selection bin 44A or 44B and thereinto.

More preferably, sorter 70 can comprise a plurality of air jets 72 extending generally across the width of sorting system 10. In this manner, when individual ones of the material 1000 is arrayed cross the width of conveyor 20 and the path of travel of material 1000, individual ones across the width of the path of travel of material 1000 can be selected to be directed into one of the selection bins 44A or 44B by actuating only those air jets 72 as would direct the selected material 1000 into the respective receiving bin 40.

Upstream from the first selection bin 44A, sorting system 10 comprises a detector system 100 capable of detecting one or more characteristics of material 1000 flowing along conveyor 20. Characteristics detected by detector system 100 can comprise reflectance (indicative of whiteness), color, presence of printing, presence of lignin or other characteristics of material 1000. Signals from detector system 100 are provided to a microprocessor 200 which then can provide a control system to sorters 70 to direct sorters 70 to direct individual ones of material 1000 into selection bins 44A or 44B provided certain measured criteria are met, or, microprocessor 200 can permit material 1000 to flow past selection bins 44A and 44B, by not actuating any of sorters 70, and thus be directed into default bin 42 if selection criteria are not met, or vice versa.

Detector System

Detector system 100 comprises a plurality of sources of narrow bandwidth electromagnetic energy or radiation 110, such as lasers 110*a*, 110*b*, 110*c*, 110*d*, 110*e*, etc. As noted above, LEDs can also be employed, and/or LEDs having a filter limiting their bandwidth. The number of sources 110 employed and the center frequency of those sources will depend on material 1000 is to be sorted. For instance, if any type of plastic resin is to be sorted from a paper stream fewer frequencies 110 will be required than if the type of plastic resin also has to be sorted as well. For instance, frequencies of interest for plastics identification are 920 nm, 1210 nm, 1425 nm, 1660, 1725 to 2000 nm and 2125 nm. The primary aseptic packaging frequency of interest is 1455 to 1485 nm and 2000 nm and 2125 nm.

Sources 110 are positioned above conveyor 20 and sequentially illuminate a section across conveyor 20. In order to avoid overlap between adjoining illuminated sections, sources 110 preferably illuminate conveyor 20 in a relatively narrow line across the width of conveyor 20. The width (i.e., thickness of the beam along the direction of travel of material 1000) of the line across conveyor 20 illuminated by sources 110 will depend on factors such as how far apart sources 110 are disposed and the rate of travel of material 1000 on conveyor 20. In a typical example, the lines illuminated across the width of conveyor 20 by sources 110 should be no more than about 1.5 centimeters (cm) in thickness, most preferably no more than about 1.0 cm in thickness.

Electromagnetic energy from sources 110 illuminates material 1000 and is then reflected into a reflectance collector or detector array 120 to measure the reflected light intensity from material 1000 illuminated by sources 110. Data from the detector array 120 is processed by a control cabinet 130, which then actuates sorters 70. Detector array 120 is comprised of an array of devices which function to collect the light reflected from material 1000 when illuminated by electromagnetic energy from sources 110, such as photodiodes or a lens array. When lignin detection via fluorescence is desired, the relevant detector array 120 would have two associated photodiodes to enable lignin detection via fluorescence.

The use of narrow bandwidth sources 110 is especially important to enable both the lignin and the plastics detection and identification. Color identification could be accomplished with a broadband source, but the lignin identification will require a source with a narrow enough bandwidth in the green range so as not to overlap the red fluorescence. Plastics and other material identification in the near infrared range will also require narrow source bandwidths to identify their characteristic sharp absorption dips and/or reflective peaks.

Lignin content would be detected using illumination of material 1000 with a source 110 comprising a narrow band green laser at 532 nm and then measuring the resulting red fluorescence via a filter and high gain detector. The intensity of the red fluorescence is dependent on the distance between lignin-containing material 1000 and detector array 120.

A potential problem with this approach lies in the fact that not all material 1000 lies flat on conveyor 20. When material 1000 is raised up from the surface of conveyor 20, such as when material 1000 is "crumpled", it is thus closer to detector array 120 and can skew the measurement of red fluorescence, since the reflection from material 1000 would be coming from a location closer to detector array 120 than if material 1000 was lying flat on conveyor 20. A solution to this problem is to factor out the intensity variation by determining lignin content through the ratio of the red fluorescence to the reflected green light, or a ratio with an average of the reflected intensity of the blue, red, and green sources.

An additional problem associated with lignin detection is the difference in the lignin fluorescence intensity due to the color of the object. Fluorescence from red and green colors tend to have a higher intensity than other colored material containing the same percentage of lignin. One possible solution to this problem is to compensate the calculated lignin content depending on the color of the material being analyzed. This can be accomplished by developing a look-up table which could be determined experimentally for the various colors and shades of colors.

There are several possible implementations of the lignin portion of the sensing. They all require two photodiode detectors per detection channel 125, with one diode allowed to receive only the red fluorescence, and potentially longer, wavelengths. In one embodiment, illustrated in FIG. 5, two photodiodes, 140*a* and 140*b*, are placed next to each other either in or near the focal plane of the lens 141. Another embodiment, illustrated in FIG. 6, is to utilize a dichroic mirror 142 to reflect energy having a wavelength of approximately 600 nm to one diode 140*a* with shorter wavelengths passing through to the other diode 140*b*.

Figure 5:
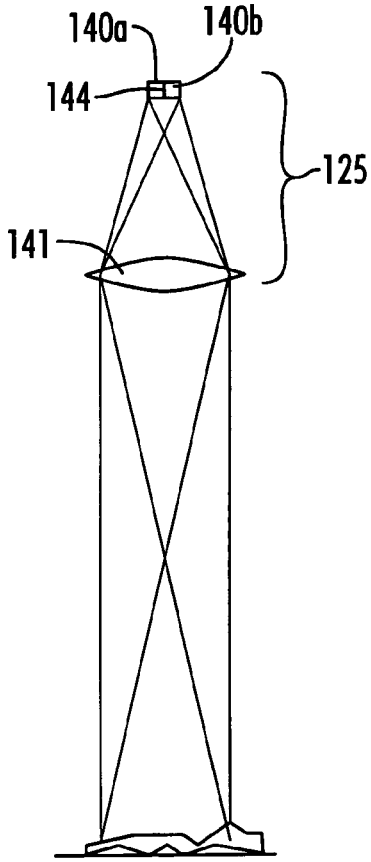
FIG. 5 is a schematic view of one embodiment of the light collector of the system of FIG. 4.

More specifically, the embodiment shown in FIG. 5 has one of photodiodes, 140*a*, covered by a bandpass filter 144 with a center frequency in the range of 650 nm with a bandwidth of 30 to 50 nm. An advantage of this embodiment is simplicity and a disadvantage is a reduction in signal level of 2 or more due to the spread of the image to accommodate the area of the two detectors 140*a* and 140*b*.

Figure 6:
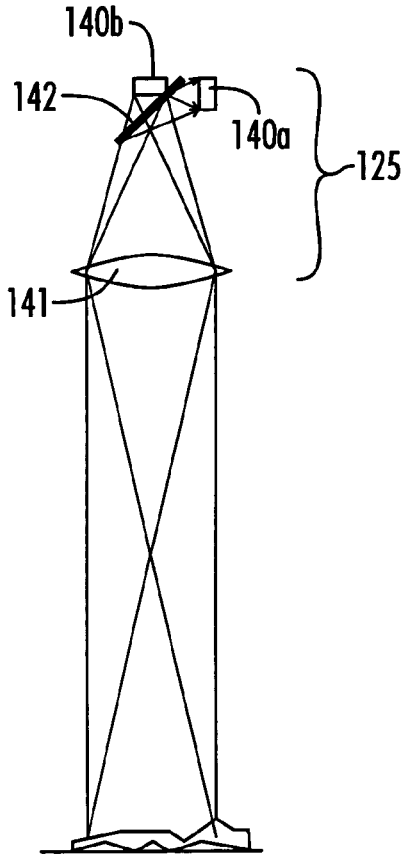
FIG. 6 is a schematic view of another embodiment of the light collector of the system of FIG. 4.

In the embodiment of FIG. 6, the dichroic mirror 142 reflects all wavelength above the green bandwidths to detector 140*a*. Detector 140*b* would measure the blue and the green reflected light. This embodiment would require that the detector 140*b* amplification be variable as the fluorescence signal is on the order of 1000 times less than the reflected green signal so it would likely be about the same for the near infrared (NIR) reflected signals. This embodiment is more complicated than the first one but would likely produce a higher relative signal level.

Figure 7:
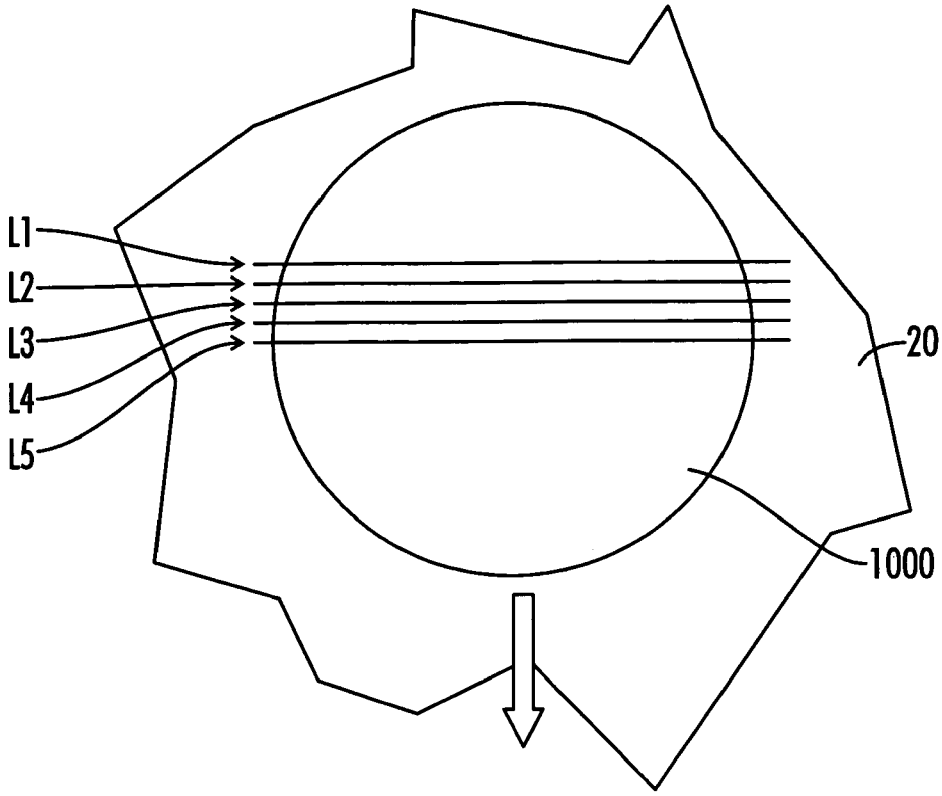
FIG. 7 is a partial top elevation view of a material 1000 passing through the detector system of the present invention, showing the lines of electromagnetic energy illumination.
Figure 8:
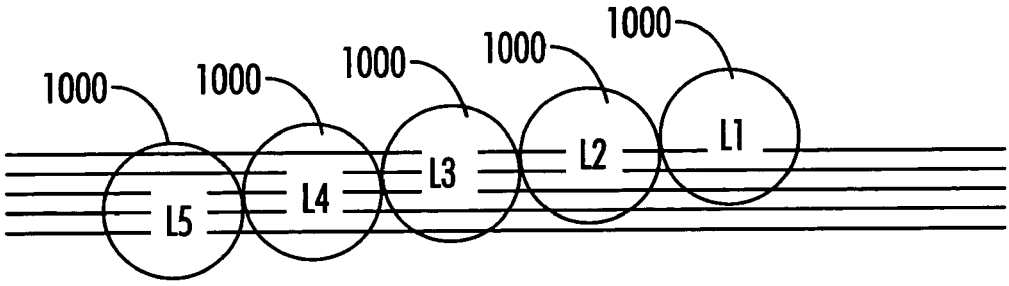
FIG. 8 is a schematic elevation view of a material 1000 passing through the detector system of the present invention, illustrating the sequential illumination of the material 1000.
Figure 9:
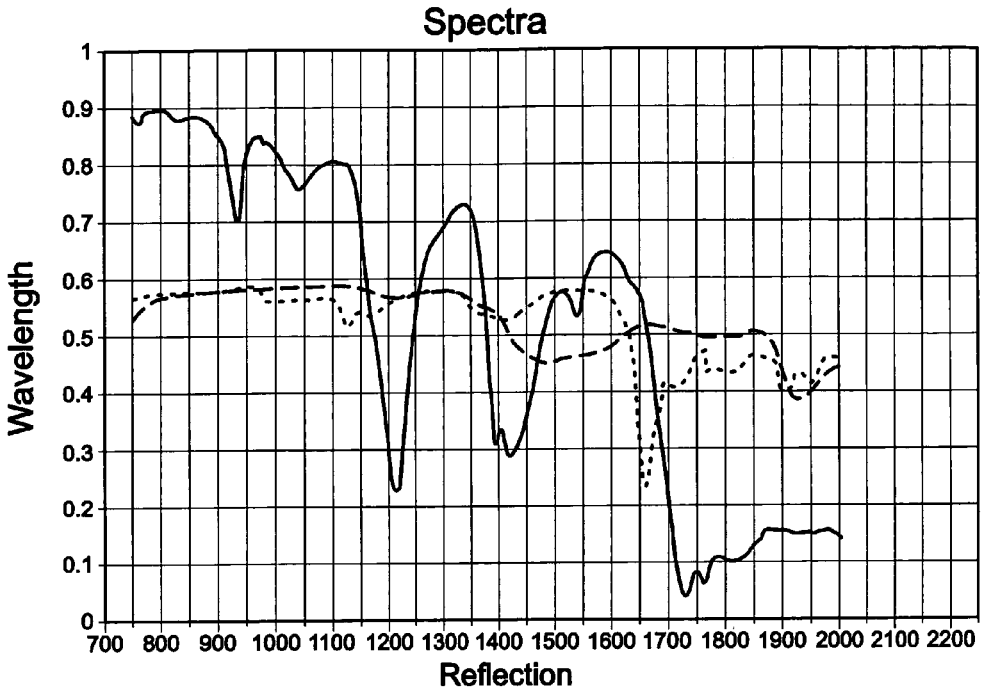
FIG. 9 is a graphical view of the reflection spectra of PET plastic (dotted line), HDPE (solid line) and paper (dashed line), respectively.
Figure 10:
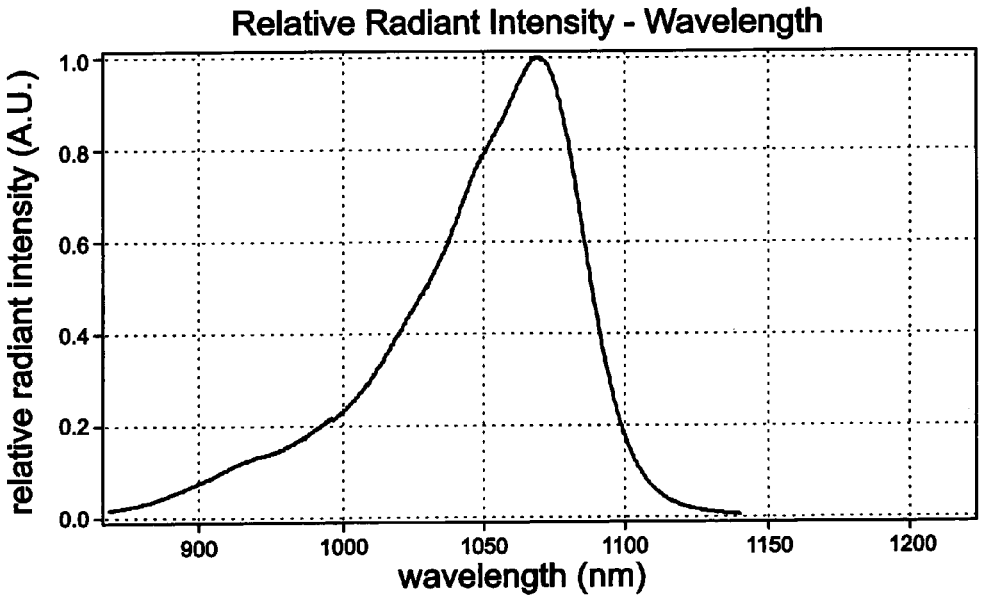
FIG. 10 is a graphical view of the typical bandwidth of LEDs.

FIGS. 7 and 8 show an alternate approach to achieving registration between the different frequencies of sources 110 with a relatively narrow beam width, by sequentially illuminating material 1000 in approximately the same place with each laser beam, designated L1-L5, respectively. The pulse rate and on time of the source 110 is coordinated to achieve this result.

Further, in order to reduce noise each pulse from a source 110 would be split into a plurality of short pulses to achieve the effect of a "chopper" system. For instance, source 110*a* would be actuated, for example, for 35 to 40 μsec, the reflected light measured, and then the detector signal measured with no illumination for 10 to 15 μsec. A "train" of such on-off pulses would require about 250 μsec to complete. During this time, if material 1000 were travelling at 1,000 feet per minute, it would have moved about 0.125 cm. Source 110*b* would then be pulsed in the same fashion as above but with the beam offset in the direction of motion by about 0.125 cm. The illumination from each subsequent source 110 would be offset by about 0.125 cm, so that each different frequency source 110 sequentially illuminates the same line across the material 1000. Sources 110 would be aligned vertically to minimize effects from variation in height of the object. The light collected by detector array 120 would be maximized, as the field of view is approximately 2.5 cm in diameter while material 1000 is illuminated during travel through the center 1.25 cm of the field of view. The beam width from each source 110 would be on the order of about 0.3 cm to 0.63 cm further "averaging" the measurements. If a slower speed for conveyor 20 is used, the on pulse would be lengthened such that the same line across material 1000 is still illuminated by each source 110. This approach does require that the measurements from each source 110 laser illumination are stored for each detector array 120 until a full set of 8 to 12 measurements are made. Once the full set of measurements is made for each array 120 the appropriate ratios can be calculated and identification made.

In operation, material 1000 is fed onto conveyor 20 using, e.g., the system disclosed by Grubbs, Kenny and Gaddis in U.S. Pat. No. 6,250,472. Entrainment airflow is also directed in the direction of the flow of travel of material 1000 defined by conveyor 20, along the direction indicated by the arrows in FIG. 1. As material 1000 continues along conveyor 20 as directed by the entrainment gas, material 1000 passes by detector system 100 which detects and/or measures the presence or absence of certain criteria, such as lignin content, whiteness, color, printed matter, etc. Material 1000 then flows across the openings of selection bins 44A and 44B as facilitated by the directional gas provided by directional gas sources 50A and 50B as well as fluidizing gas provided by source 60 and into default bin 42. However, when material 1000 meeting certain criteria, such as reflectivity, etc., passes by detector system 100, a signal is sent from detector system 100 to microprocessor 200 which then actuates one or more sorters 72 to direct individual one of material 1000 into one of the respective selection bins 44A and 44B. In this manner, sorting of material 1000 such as carrier board and paper can be accomplished at sufficiently high speeds and with sufficient accuracy and flexibility to be economical.

Figure 11:
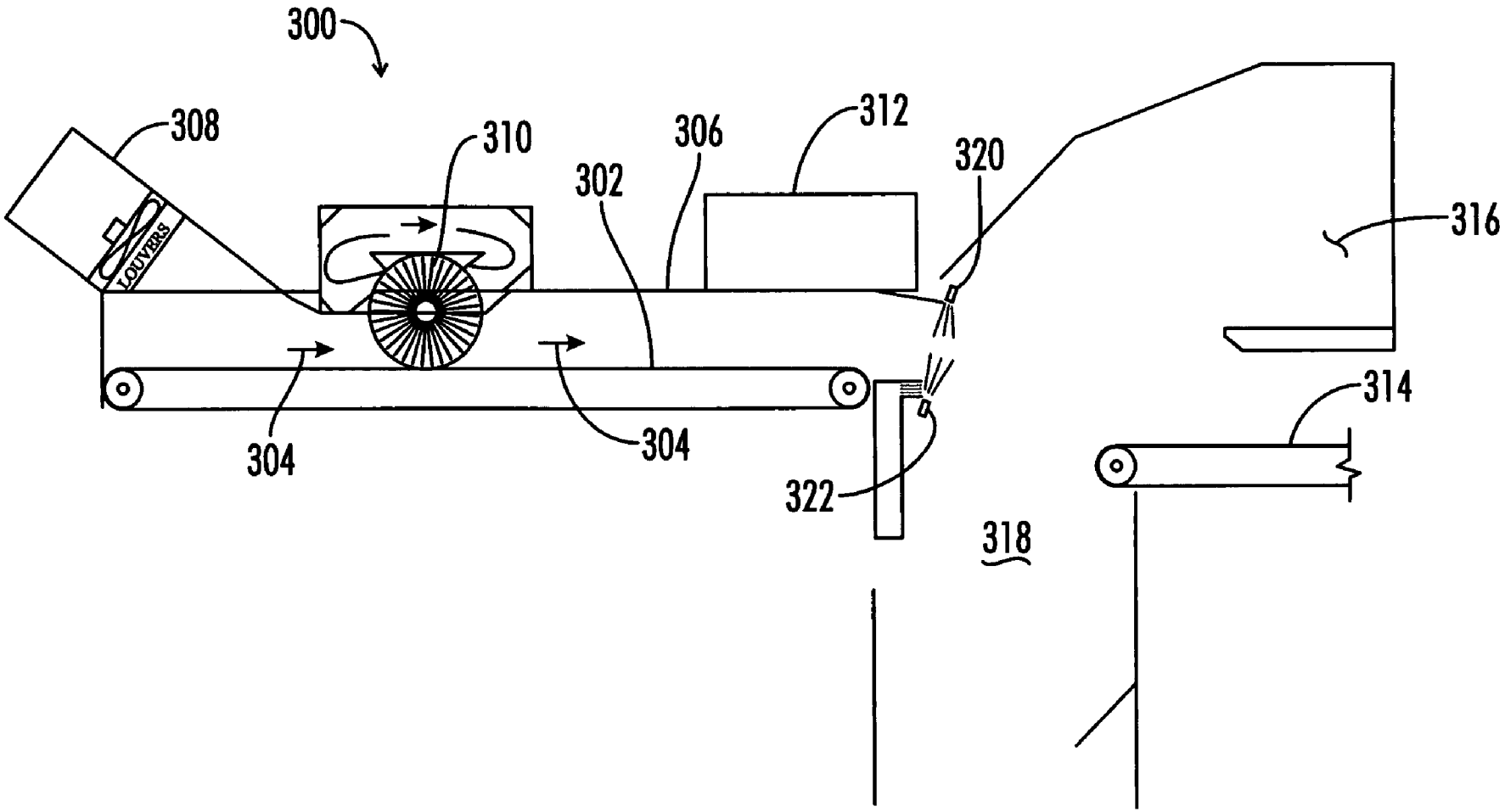
FIG. 11 is a side cross-sectional view similar to FIG. 1 of an alternative embodiment of the sorting system of the present invention.

Alternative Embodiment of FIG. 11

FIG. 11 is a schematic sectioned elevation view similar to FIG. 1 showing an alternative arrangement for the conveyor and various mechanical aspects of the separator apparatus which is generally designated in FIG. 11 by the numeral 300. The apparatus 300 includes an endless conveyor belt 302 which in FIG. 11 moves from left to right as indicated by the arrows 304. The conveyor 302 is enclosed by a ductwork or housing 306 and an air assist is provided by an air source 308. A rotary pinning wheel 310 aids in pinning the paper articles to the surface of the moving conveyor belt 302. Rotary pinning wheel 310 is generally constructed in accordance with the teachings of U.S. Pat. No. 6,374,998 issued Apr. 23, 2002 to Grubbs et al. and entitled "Acceleration Conveyor", the details of which are incorporated herein by reference.

Figure 12:
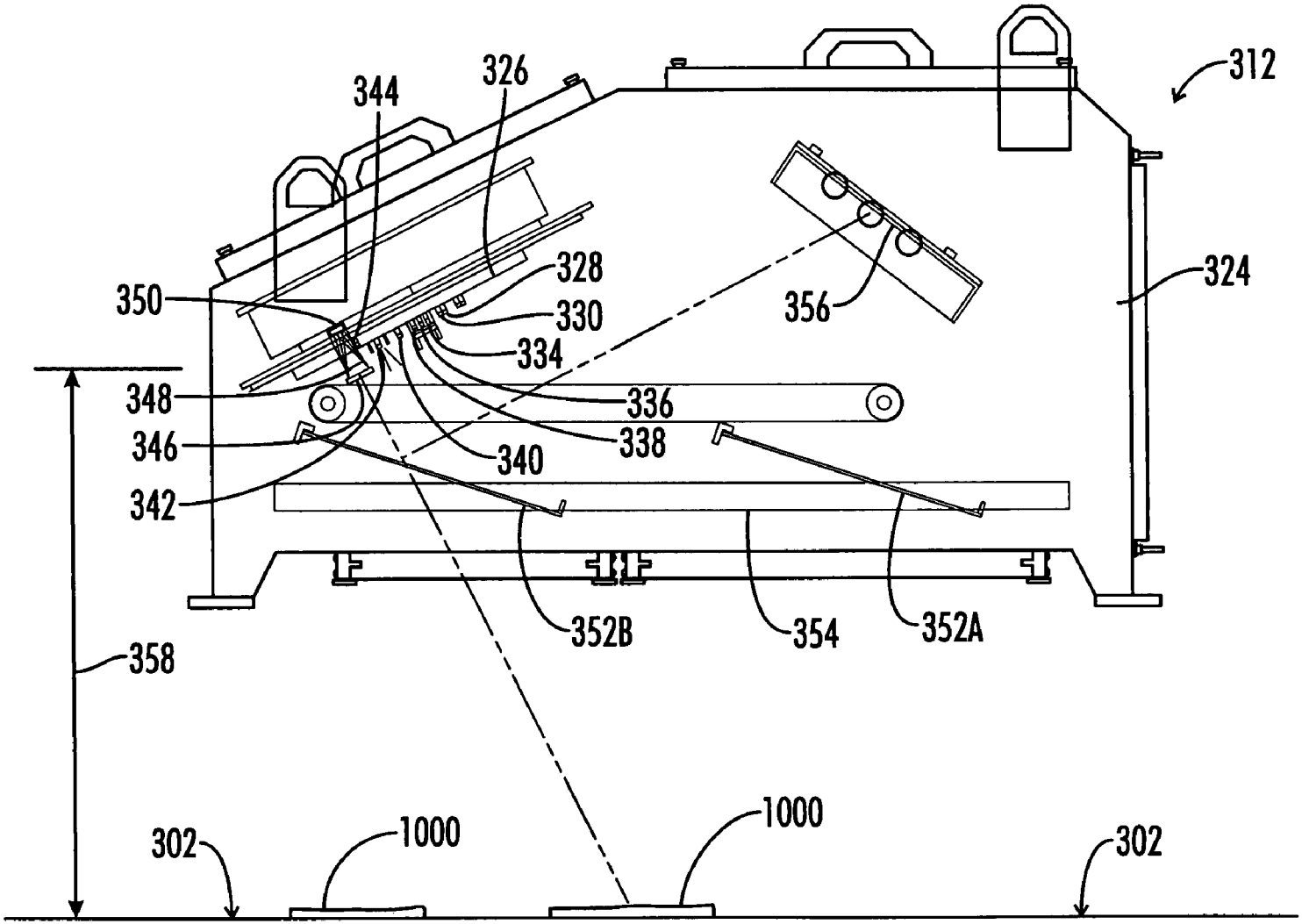
FIG. 12 is an enlarged side elevation cross section view of the sensor system of the embodiment of FIG. 11.

Near the end of conveyor belt 304 there is located a sensor system 312 which is shown in more detail in FIG. 12.

Downstream of the conveyor belt 302 there is a primary discharge conveyor 314, an upper discharge chute 316, and a lower discharge chute 318.

An array of downwardly directed air jets 320 can blow a first category of selected articles out of the primary discharge stream into the lower discharge chute 318, which can be referred to as a first alternative destination.

An array of upwardly directed air jets 322 can deflect a second category of selected articles from the primary stream into the upper discharge chute 316, which can be referred to as a second alternative destination.

Thus the apparatus 300 can separate the stream of articles on conveyor belt 302 into three separate discharge streams.

Referring now to FIG. 12, the sensor system 312 has a housing 324. A light source panel 326 is mounted in housing 324 and has mounted thereon an array of narrow-band light sources such as LEDs which are arranged in rows such as rows 328, 330, 334, 336, 338, 340 and 342.

Also mounted within housing 24 adjacent the light source panel 326 is an array of light collectors 344.

The LEDs 328 through 342 illuminate the conveyor belt 302 and the paper articles 1000 carried by conveyor belt 302, and light reflected or fluoresced from the articles 1000 is collected by the collectors 344. The collectors 344 may also be described as telescopes 344. The telescopes 344 comprise a lens 346 at one end of a barrel 348 with antireflective grooves and a photodiode 350 at the other end. Light is received at the photodiode 350 from an area on the target material below. The size of the target area is controlled by the focal length and location of the lens. In this case the area is about 1 inch diameter. And the lenses are on one inch spacing across the array. The sensor utilizes a silicon photodiode for the visible part of the spectrum, but these are not responsive in the infrared area of the spectrum. So for the infrared (>1000 nm wavelength) wavelengths, InGaAs (Indium-Gallium-Arsenide) type diodes are used. Additionally, the lignin sensor system must operate with a silicon detector which is covered with a red filter so it only responds to the red (fluorescence) component of the reflected light from a bright green LED flash. Rather than use three telescope arrays to implement the three above mentioned receiving tasks, one telescope array with three sensor elements is used. The three photodiodes (silicon, InGaAs, and silicon/red filter) are side by side in a row under each telescope lens 346. The row of three sensors is oriented along the material travel direction. The InGaAs diode is on the centerline of the telescope, so it receives light from directly under the telescope on the target material. The other diodes, being located off center, receive light from either upstream on the target material or downstream. In this way the telescope array reads data from a row of pixels (spots) on the target material for infrared, and a separate row of pixels on the target material for the visible located upstream and parallel to the infrared row, and a 3rd row of pixels on the target material for the lignin fluorescence located downstream and parallel to the infrared reading. The data which is "non-coherent" is corrected in the software by delaying the upstream readings data so that it is returned to its correct location to produce a coherent image. In other words, the various data is not read from the target material at the same place and at the same time, but this is corrected in the software.

As also seen in FIG. 12, a reference mirror 352 is normally located in location 352A, but can slide on a set of tracks 354 into a reference position 352B. The mirror 352B moves in from the illuminator/reflector section and redirects light from the belt to an internal reference plate 356 composed of white alumina ceramic. This serves as a calibration standard to produce a flat spectrum sensitivity from the sensor. This is automatically conducted at intervals to ensure the sensors correct operation at various temperatures and over time. The internal reference also includes a calibration material for the lignin fluorescent sensor which is stabilized newsprint paper. The newsprint has been laminated to a white polyester backing with clear epoxy resin.

As seen in FIG. 12, the light sources 328 through 342 are located at a height 358 above the upper surface of belt 302. The height 358 is preferably in the range of from about 20 to about 24 inches. The height 358 is preferably no greater than about 26 inches.

Figure 13:
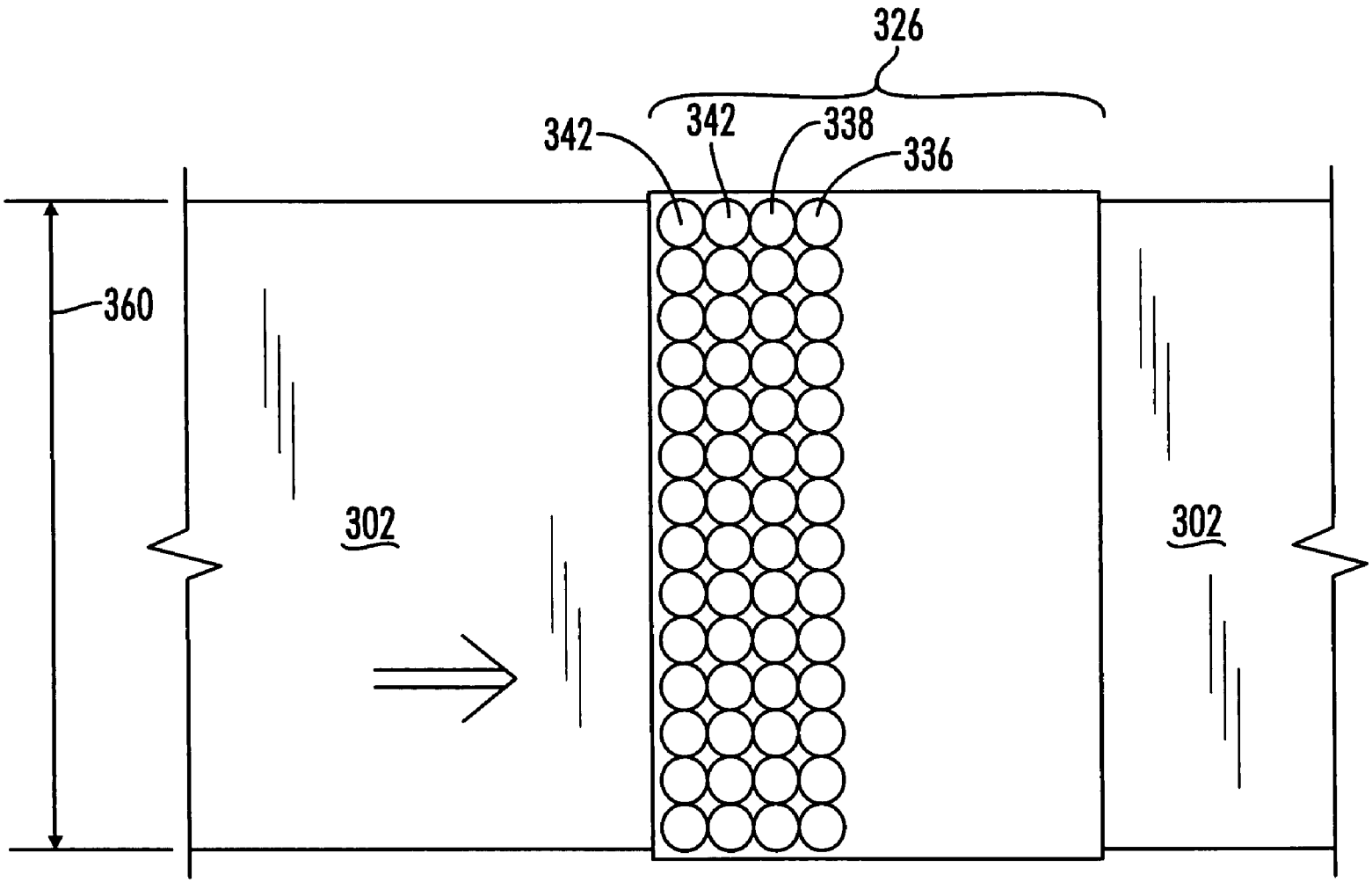
FIG. 13 is a schematic plan view of the light source array for the sensor system of FIG. 12, superimposed upon the width of the conveyor system.

FIG. 13 is a schematic plan view showing a portion of the upper surface of conveyor 302, and showing the location of the array of light sources 328 through 342 of the light source panel 326 in schematic form. The sources in each row have the same frequency with the sources of different rows having different frequencies.

For each different frequency or wavelength of narrow-band width source utilized, the array of light sources includes a row such as row 342 across the width 360 of the conveyor 302. Only four such rows are illustrated in FIG. 13 for convenience of illustration, but it will be understood that there will be one such row for each different frequency source utilized. In one preferred embodiment of the invention, the light source panel 326 is constructed to receive up to 14 rows of light sources. The actual number of sources in each row will depend on the width 360 of the conveyor 302. One unique advantage of the sensor system of the present invention made up of such an array of narrow-band light sources is that the array of light sources can be placed at a relatively low height 358 (see FIG. 12) above the conveyor belt 302 and can extend to any width 360 that is desired. Thus the present arrangement allows the construction of conveyor belts having a solitary sensor system of practical size that can observe across the entire width of the belt. Accordingly, belt widths 360 of as great as seven feet and even more preferably of as great as eight feet or more can be accommodated with the light source and sensor system of the present invention. Such a belt width cannot be utilized with more typical sensor systems of the prior art such as camera systems. A typical camera system, for example, has about a 40° field of view, so the camera must be located five to six feet above the belt to even observe a four to five foot belt width.

Furthermore, due to their much greater height above the belt, camera type systems can encounter more difficult signal-to-noise problems than are encountered with the system of the present invention. Furthermore, utilizing camera systems, objects at the edge of the field of view are at a different angle relative to the illumination than are objects in the center of the field of view, and this affects the reflected spectrum.

In combination with the high speed paper handling system of the present invention which can operate at speeds of as much as 1200 feet per minute (fpm), a paper sorting system utilizing the sensor apparatus of the present invention can provide the extremely high capacities that are necessary to make automated paper sorting economical. As will be appreciated, the width of the belt and the speed of the belt basically determine the volume of paper that can be handled, assuming that the sensor system is capable of identifying and sorting the material at such a speed. The system of the present invention as noted operates at high speeds which can be generally described as operating at speeds of at least about 600 fpm, more preferably at least about 1000 fpm and most preferably 1200 fpm or greater.

Figure 14:
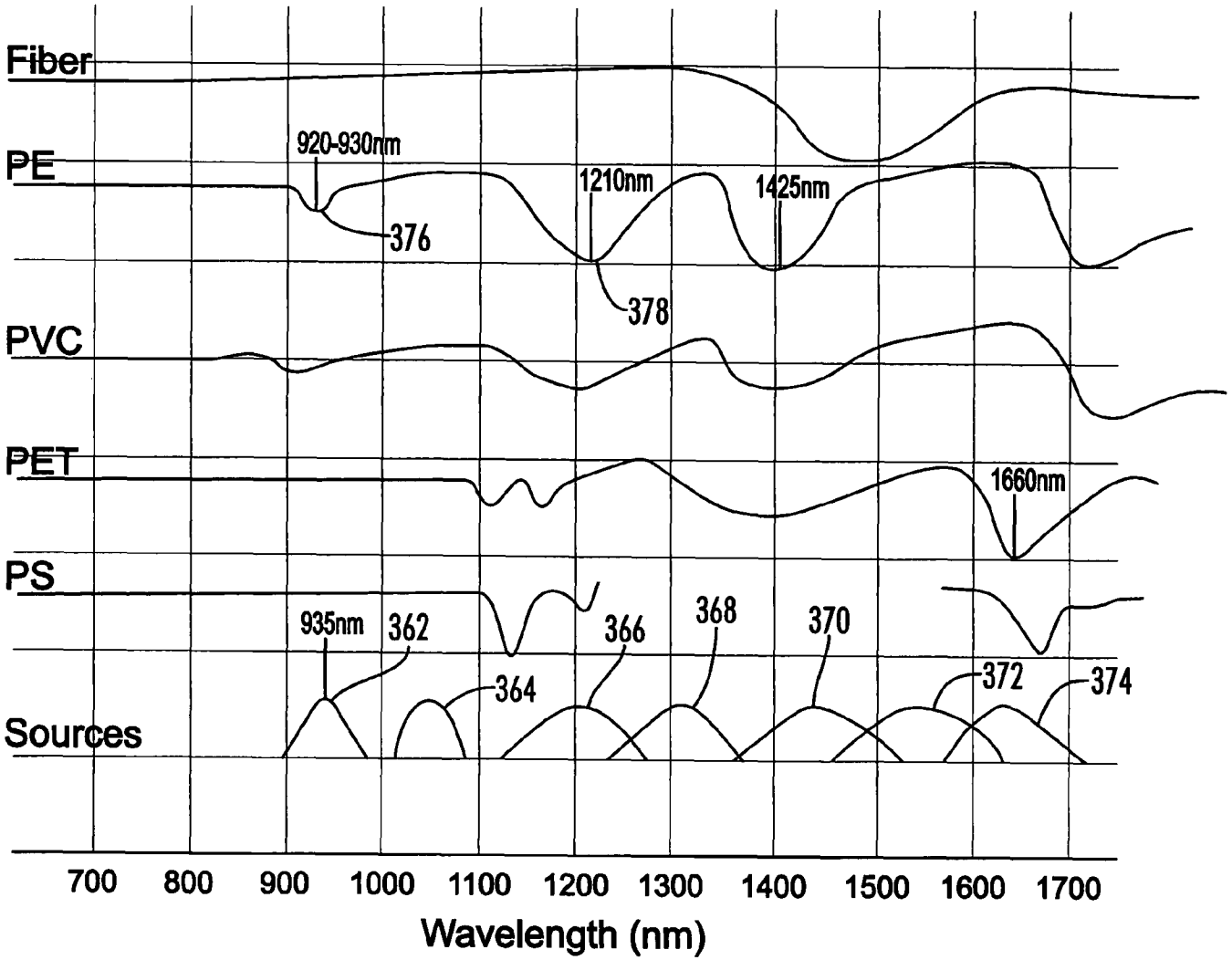
FIG. 14 is a graphical view similar to FIG. 9 of the absorption spectra of fiber (paper), PE plastic (polyethylene), PVC (polyvinylchloride), PET plastic, and PS plastic (polystyrene), with the bandwidth of several preferred narrow bandwidth sources in the near infrared spectrum superimposed thereon.

Turning now to FIG. 14, an illustration is there shown of the characteristic absorption spectra of cellulose fiber materials, polyethylene (PE), polyvinylchloride (PVC), polyethylene terephthalate (PET, a thermoplastic polymer of the polyester family), and polystyrene (PS) materials juxtaposed to the narrow-band spectra of a number of preferred light sources which may be utilized with the present invention. It will be appreciated that the curves of FIG. 14 are drawn in an approximation to show the most significant features of the respective spectra, and the curves of FIG. 14 are not exact. They are intended only to illustrate the general manner of operation of the invention.

One preferred sensor system 312 uses a light source array having red, green and blue sources in the visible spectrum and eight different infrared lengths as shown in the following Table I:

TABLE I

| |
|---|
| blue |
| green |
| red |
| 935 nm |
| 1050 nm |
| 1200 nm |
| 1300 nm |
| 1420 nm |
| 1480 nm |
| 1550 nm |
| 1650 nm |

As previously noted a green light source located at 532 nm wavelength (not shown on FIG. 13) is also preferably utilized to identify the lignin content in certain types of fiber or paper materials.

The eight different near infrared wavelengths from Table I are illustrated along the lower portion of FIG. 13 by short, dome shaped curves representative of the bandwidth of the sources.

The first curve 362 represents the bandwidth of the 935 nm source, which may for example be a model HEMT-3301 LED available from Agilent Technologies.

Curve 364 is representative of the 1050 nm wavelength source which may for example be a model LED 1050-03 available from Epitex.

Curve 366 is representative of the source centered at around 1200-1210 nm which may for example be a model LED 1200-03 available from Epitex, in combination with a custom 1200 nm×40 nm bandwidth interference filter available from Intor, Inc.

Curve 368 is representative of the 1300 nm source which may for example be a model LED 1300-03 available from Epitex.

Curve 370 is representative of two of the sources, namely the 1420 nm source and the 1480 nm source. The 1420 nm source is for example provided with a model LED 1450-03 available from Epitex and having a center frequency of 1450 nm wavelength in combination with a custom 1420 nm×40 nm bandwidth interference filter available from Intor, Inc. to provide a source centered at approximately 1420 nm wavelength.

The 1480 nm source is in turn provided by an identical 1450 nm LED which may be a model LED 1450-03 available from Epitex, combined with a custom 1480 nm×40 nm bandwidth filter available from Intor, Inc. to provide a source centered at approximately 1480 nm wavelength.

Curve 372 is representative of the 1550 nm source which may for example be a model LED 1550-03 available from Epitex.

Finally, curve 374 is representative of the 1650 nm source which may for example be a model L8245 LED available from Hamamatsu.

Referring now to the positions of the various sources 362 through 374 in relationship to the characteristic absorption spectra of the four materials located in the upper portion of FIG. 14, the manner of use and selection of the preferred LEDs will be described. Typically, two adjacent LEDs are utilized to identify one characteristic feature from the absorption spectra of the various materials. For example, sources 362 and 364 may be utilized to look for the dip 376 which is centered in the absorption spectra for polyethylene at approximately 920-930 nm wavelength. By looking at the light reflected from source 362 at approximately 935 nm and comparing that by reference to source 364 at approximately 1050 nm wavelength, for polyethylene a detectably stronger signal will be reflected from source 364 than from source 362. PVC has a similar absorption spectra to PE, but the first three characteristic dips are less pronounced. But for fiber, PET or polystyrene, approximately equal reflections will result from sources 362 and 364.

Similarly, sources 366 and 368 can be used to detect the characteristic dip 378 in the polyethylene absorption spectra centered at about 1210 nm in wavelength. Again for PVC there is also a dip at about 1210 nm which is less pronounced.

The two sources at 1420 nm and 1480 nm wavelength represented in curve 370 can be utilized to distinguish between fiber, polyethylene and PET. The PET material will show a small increase in reflectance between 1420 and 1480 nm. The polyethylene material will show a much sharper increase in reflectance between 1420 and 1480 nm. The PVC will show an increase somewhat between that of PET and polyethylene. The fiber material, in contrast, will show a decrease in reflection between 1420 and 1480 nm.

Through a combination of such observations focused on various characteristic portions of the absorption spectra of the materials of concern, an array of sources can be selected which will allow the desired selection to occur.

As previously described, a sequential LED flash and Read sequence is designed to reduce motion induced chromatic aberration. Since the wavelength readings must be conducted sequentially, a problem results because the material may move during the read sequence. If the total reflectivity of the pixels area changes because of the motion, for example if a black edge is moving into view in a white area, a type of false spectral signature is created. In this case the later readings would be lower reflectivity as the black edge moves in. This would result in a non-flat spectrum reading. However in this case the correct spectrum should be flat because there is no color present. (black and white only) This situation is partially corrected by using a symmetrical redundant read sequence shown in the following Table II.

TABLE II

| |
|---|
| start: |
| LIGNIN |
| 1650 nm |
| 1550 nm |
| 1480 nm |
| 1420 nm |
| 1300 nm |
| 1200 nm |
| 1050 nm |
| 930 nm |
| red |
| grn |
| blu |
| <<< center of sequence |
| blu |
| grn |
| red |
| 930 nm |
| 1050 nm |
| 1200 nm |
| 1300 nm |
| 1420 nm |
| 1480 nm |
| 1550 nm |
| 1650 nm |
| LIGNIN |
| finish |

The sequence is symmetrical about the center and each color or wavelength is read twice. To produce the output result the two readings for each wavelength are averaged together. The benefit of sequence is as follows. If a black edge, for example, is moving across the pixel, then the read spectrum will be "tilted". If we read the spectrum again in the reverse order, the "tilt" will be in the opposite direction. If we average the two spectra together, the result is correct and flat.

Thus the present system utilizing the preferred array of sensors in Table I provides the ability to distinguish between paper materials and plastic materials. Additionally the ability is provided to distinguish and identify various types of paper materials including carrier board, white paper and newspaper articles. Additionally, the ability is provided to distinguish and identify various types of plastic materials including polyethylene, polyester (such as PET), polystyrene, and PVC materials.

It is seen in FIG. 14 that typically two of the infrared sources are used to identify a given characteristic shape in one or more of the absorption spectra of the materials of concern. Thus it is preferable that the selected plurality of narrow-band width sources include at least two sources of differing frequency within the near infrared range, which as previously noted is from about 680 nm wavelength to about 2000 nm wavelength. More preferably at least four sources of differing frequency within the near infrared range are used. Even more preferably at least six sources of differing frequencies within the near infrared range are used, and most preferably at least eight sources of differing frequencies within the near infrared range are used. More than eight sources may also be used. The sources within the near infrared range are preferably combined with at least three sources in the visible light range, preferably red, green and blue sources as previously described. Also a green source focused on the 532 nm wavelength is preferably included, which as previously described will create a red fluorescence from lignin and can be utilized to identify lignin-containing articles.

Identification software developed for the sensor system 312 uses a spectrum shape analysis technique with selective weighting. The intent of the analysis is to identify a spectrum by its shape and to ignore features other than the shape. The spectrum data for each pixel is processed to normalize the size of the features to a standard level. Undesirable attributes which would detract from the shape analysis are removed. The shape may then be compared to several standard references to determine the best match. The mathematical technique used for this is to convert an example spectrum to a collection of slope segments which are thought of as a vector or point location in a space of order n=7. (This is the number of wavelengths−1) This set of 7 numbers is stored as a reference. Unknown spectra (data) are compared to the reference by computing the distance in space from the reference vector to the unknown vector. This calculation is made for all of the stored reference spectral shapes or vectors, and the smallest result represents the reference that most closely matches the unknown. For this reason the software is referred to as "vector" software. It is believed that this technique provides a maximally optimum identification. In other words, all valid information from the input data is utilized. Additionally, the vector match analysis may be weighted to favor shape features which are deemed to be most important for a particular separation. The weighting mask used can be generated by an analysis tool (software) to produce an optimum separation. The way this works is as follows. After reading data from sample material and generating a number of vector references, a subset of references may be chosen for weighted separation. This subset would include two types of materials for which an improved separation is desired. An example would be PE and PVC. It is known that these two plastics produce relatively similar spectra. The question that is essentially answered by the analysis tool is "Which part of the spectrum includes the shape difference that is most important for separating these items?" The answer is produced in the form of a weighting mask which is simply a set of n−1 (7) weighting factors. Having this, the vector or shape analyzer software can use the weighting mask to favor spectral features that are important to the separation, and ignore features that do not matter. This will produce a more reliable identification. The analysis tool generates the weighting mask by statistical analysis of two selected reference sets. (several PE and several PVC vectors, for example) to determine where the difference lies.

All cited patents and publication referred in this application are incorporated by reference.

The invention thus being described, it will be apparent that it may be varied in many ways. Such variations are not to be regarded as a departure from the spirit and scope of the present invention and all such modifications as would be apparent to one skilled in the art are intended to be included within the scope of the following claims.

What is claimed is:

1. A sorting apparatus, comprising:

a plurality of narrow bandwidth sources of electromagnetic energy including at least four sources of differing frequencies within the near-infrared range of from about 680 nm wavelength to about 2000 nm wavelength, for illuminating articles;

a collector for collecting and measuring electromagnetic energy reflected or fluoresced from the articles, and for generating control signals in response to one or more measured parameters of the articles;

a deflector for deflecting selected articles toward an alternative destination; and a control system, operably connected to the collector and the deflector, for actuating the deflector in response to the control signals.

2. The apparatus of claim 1, wherein:

the plurality of narrow bandwidth sources includes at least six sources of differing frequencies within the near infrared range of from about 680 nm wavelength to about 2000 nm wavelength, said at least six sources including said at least four sources.

3. The apparatus of claim 1, wherein:

the plurality of narrow bandwidth sources includes at least eight sources of differing frequencies within the near infrared range of from about 680 nm wavelength to about 2000 nm wavelength, said at least eight sources including said at least four sources.

4. The apparatus of claim 1, wherein:

the plurality of narrow bandwidth sources further includes red, green and blue sources within the visible light spectrum.

5. The apparatus of claim 1, wherein:

the plurality of narrow bandwidth sources are selected such that the collector can distinguish and identify carrier board, white paper and newspaper articles.

6. The apparatus of claim 5, wherein:

the plurality of narrow bandwidth sources are further selected such that the collector can distinguish and identify polyethylene and polyester articles.

7. The apparatus of claim 5, wherein:

the plurality of narrow bandwidth sources are further selected such that the collector can distinguish and identify PVC articles.

8. The apparatus of claim 1, wherein:

the plurality of narrow bandwidth sources are selected such that the collector can distinguish and identify polyethylene and polyester articles.

9. The apparatus of claim 1, wherein:

the plurality of narrow bandwidth sources are selected such that the collector can distinguish and identify PVC articles.

10. The apparatus of claim 1, further comprising:

a conveyor for conveying the articles, the conveyor having a width of at least about seven feet; and wherein the plurality of narrow bandwidth sources is arranged in an array including at least four rows of said sources extending across the width of the conveyor, each row having sources of the same frequency, the sources of different rows having different frequencies.

11. The apparatus of claim 10, wherein the sources are located at a height above the articles of no greater than about 26 inches.

12. The apparatus of claim 10, wherein the conveyor has a width of at least about eight feet.

13. The apparatus of claim 10, wherein the conveyor has an operating speed of at least about 600 fpm.

14. The apparatus of claim 10, wherein the conveyor has an operating speed of at least about 1000 fpm.

15. The apparatus of claim 1, wherein the deflector comprises:

a first air jet for deflecting a first category of selected articles toward a first alternative destination; and a second air jet for deflecting a second category of selected articles toward a second alternative destination.

16. The apparatus of claim 15, wherein one of said first and second air jets is directed downwardly and the other is directed upwardly.

17. A sorting apparatus, comprising:

a plurality of narrow bandwidth sources of electromagnetic energy, including:

a narrow bandwidth source of red light;

a narrow bandwidth source of green light;

a narrow bandwidth source of blue light; and at least four narrow bandwidth sources of differing wavelengths in the range of from about 680 nm to about 2000 nm;

a collector for collecting and detecting electromagnetic energy reflected or fluoresced from the articles, for identifying and distinguishing both paper and plastic articles and for generating control signals in response to one or more measured parameters of the articles;

a deflector for deflecting selected articles toward an alternative destination; and a control system, operably connected to the collector and the deflector, for actuating the deflector in response to the control signals.

18. The apparatus of claim 17, wherein:

the plurality of narrow bandwidth sources are selected such that the collector can distinguish and identify carrier board, white paper and newspaper articles.

19. The apparatus of claim 18, wherein:

the plurality of narrow bandwidth sources are further selected such that the collector can distinguish and identify polyethylene and polyester articles.

20. The apparatus of claim 18, wherein:

the plurality of narrow bandwidth sources are further selected such that the collector can distinguish and identify PVC articles.

21. The apparatus of claim 17, wherein:

the plurality of narrow bandwidth sources are selected such that the collector can distinguish and identify polyethylene and polyester articles.

22. The apparatus of claim 17, wherein:

the plurality of narrow bandwidth sources are selected such that the collector can distinguish and identify PVC articles.

23. The apparatus of claim 17, further comprising:

a conveyor for conveying the articles, the conveyor having a width of at least about seven feet; and wherein the plurality of narrow bandwidth sources is arranged in an array including at least four rows of said sources extending across the width of the conveyor, each row having sources of the same frequency, the sources of different rows having different frequencies.

24. The apparatus of claim 23, wherein the sources are located at a height above the articles of no greater than about 26 inches.

25. The apparatus of claim 23, wherein the conveyor has a width of at least about eight feet.

26. The apparatus of claim 23, wherein the conveyor has an operating speed of at least about 600 fpm.

27. The apparatus of claim 23, wherein the conveyor has an operating speed of at least about 1000 fpm.

28. The apparatus of claim 17, wherein the deflector comprises:

a first air jet for deflecting a first category of selected articles toward a first alternative destination; and a second air jet for deflecting a second category of selected articles toward a second alternative destination.

29. The apparatus of claim 28, wherein one of said first and second air jets is directed downwardly and the other is directed upwardly.

30. A sorting apparatus, comprising:

a conveyor for conveying articles, the conveyor having a width of at least about seven feet;

a plurality of narrow bandwidth sources of electromagnetic energy including an array of sources including at least four rows of sources extending across the width of the conveyor, each row having sources of the same frequency, the sources of different rows having different frequencies;

a collector for collecting and measuring electromagnetic energy reflected or fluoresced from the articles, and for generating control signals in response to one or more measured parameters of the articles;

a deflector for deflecting selected articles toward an alternative destination; and a control system, operably connected to the collector and the deflector, for actuating the deflector in response to the control signals.

31. The apparatus of claim 30, wherein the sources are located at a height above the articles of no greater than about 26 inches.

32. The apparatus of claim 30, wherein the conveyor has a width of at least about eight feet.

33. The apparatus of claim 30, wherein the conveyor has an operating speed of at least about 600 fpm.

34. The apparatus of claim 30, wherein the conveyor has an operating speed of at least about 1000 fpm.

35. The apparatus of claim 30, wherein the deflector comprises:

a first air jet for deflecting a first category of selected articles toward a first alternative destination; and a second air jet for deflecting a second category of selected articles toward a second alternative destination.

36. The apparatus of claim 35, wherein one of said first and second air jets is directed downwardly and the other is directed upwardly.

* * * * *

UNITED STATES PATENT AND TRADEMARK OFFICE

CERTIFICATE OF CORRECTION

PATENT NO. : 7,816,616 B2
APPLICATION NO. : 11/615052
DATED : October 19, 2010
INVENTOR(S) : Kenny et al.

It is certified that error appears in the above-identified patent and that said Letters Patent is hereby corrected as shown below:

Column 1, line 43, replace "do" with --so--.
Column 8, line 19, replace "cross" with --across--;
line 49, insert --the-- before --material--;
line 49, insert --which-- before --is--.

Signed and Sealed this

Fourteenth Day of December, 2010

David J. Kappos

David J. Kappos
*Director of the United States Patent and Trademark Office*